US007185466B2

(12) United States Patent
Randjelovic

(10) Patent No.: US 7,185,466 B2
(45) Date of Patent: Mar. 6, 2007

(54) SUB-FLOORING ASSEMBLY FOR SPORTS FLOOR AND METHOD OF FORMING THE SAME

(75) Inventor: Erlin Randjelovic, Crystal Falls, MI (US)

(73) Assignee: Connor Sports Flooring Corporation, Arlington Heights, IL (US)

( * ) Notice: Subject to any disclaimer, the term of this patent is extended or adjusted under 35 U.S.C. 154(b) by 259 days.

(21) Appl. No.: 10/850,302

(22) Filed: May 20, 2004

(65) Prior Publication Data

US 2005/0257474 A1 Nov. 24, 2005

(51) Int. Cl.
*E04F 15/22* (2006.01)

(52) U.S. Cl. ..... 52/403.1; 52/480; 52/506.05

(58) Field of Classification Search ..... 52/403.1, 52/480, 506.01, 506.05, 747.1, 747.11, 508, 52/509, 510, 506.6, 748.1, 512
See application file for complete search history.

(56) References Cited

U.S. PATENT DOCUMENTS

| | | | | |
|---|---|---|---|---|
| 726,506 | A | 4/1903 | Capen | |
| 5,016,413 | A | 5/1991 | Counihan | |
| 5,365,710 | A | 11/1994 | Randjelovic | |
| 5,388,380 | A * | 2/1995 | Niese | 52/480 |
| 5,609,000 | A * | 3/1997 | Niese | 52/480 |
| 5,647,183 | A * | 7/1997 | Counihan | 52/403.1 |
| 5,682,724 | A | 11/1997 | Randjelovic | |
| 5,778,621 | A | 7/1998 | Randjelovic | |
| 6,032,427 | A | 3/2000 | Randjelovic | |
| 6,073,409 | A * | 6/2000 | Chambers | 52/403.1 |
| 6,122,873 | A | 9/2000 | Randjelovic | |
| 6,158,185 | A * | 12/2000 | Counihan | 52/403.1 |
| 6,164,031 | A * | 12/2000 | Counihan | 52/480 |
| 6,490,838 | B2 * | 12/2002 | Summerford | 52/650.3 |
| 6,688,065 | B2 * | 2/2004 | Chambers | 52/480 |
| 6,883,287 | B2 * | 4/2005 | Niese et al. | 52/403.1 |
| 7,096,631 | B1 * | 8/2006 | Counihan | 52/403.1 |
| 2004/0040242 | A1 | 3/2004 | Randjelovic | |
| 2005/0193670 | A1 * | 9/2005 | Niese et al. | 52/403.1 |

OTHER PUBLICATIONS

Connor Sports Flooring Corporation, Schannel, System Features and Benefits, www.connorfloor.com.
CRP Safe Eco System.
All-Wood ERS, ERS-R1 Systems.
Action Channel I, www.actionfloors.com.
Action Channel II, www.actionfloors.com.
Action Channel-Flex II, www.actionfloors.com.
Superior Floor Company Inc., Superior Ultra-Channel DC Floor System, www.superiorfloor.com.
Superior Floor Company Inc., Ultra-Flex DC Floor System, www.superiorfloor.com.
Robbins, Maple Floor Systems, Bio-Channel LP, www.robbinsfloor.com.

* cited by examiner

*Primary Examiner*—Lanna Mai
*Assistant Examiner*—Paul Devoti
(74) *Attorney, Agent, or Firm*—Gary R. Jarosik

(57) ABSTRACT

A sub-floor assembly having sub-floor panels that are adapted to be integrally overlapped while providing clearance for channel sections when the floor deflects under load. Clearance for the channel sections may be achieved by providing pockets in an upper layer of a first sub-floor panel in the area where the channel sections engage a second sub-floor panel with which the first sub-floor panel is in overlapping engagement.

15 Claims, 5 Drawing Sheets

SUB-FLOORING ASSEMBLY FOR SPORTS FLOOR AND METHOD OF FORMING THE SAME

BACKGROUND

The following generally relates to sub-floor assemblies and, more particularly, to a sub-flooring assembly which is to be placed under a sports floor.

As described in commonly assigned, U.S. Pat. No. 5,778,621, sports floors have certain requirements above and beyond floors used for non-athletic purposes. Athletic floors should have some degree of elasticity under load, and yet be quite firmly supported. Further, a sports floor should be uniformly supported and level throughout the entire surface so that there are no dead spots or uneven spots which could affect the activity occurring on the sports floor.

Numerous attempts have been made to design a sports floor with such ideal characteristics. Resiliency is typically obtained by implementing a shock absorbing system into the sub-floor. Shock absorbing systems are in wide use in sports flooring installations. Typical systems provide a sub-floor of softwood sleepers or plywood sheeting supported by isolated resilient pads. These designs allow deflection under active loads offering shock absorbency of the system to the athletic participant. Examples of shock absorbing systems are disclosed in U.S. Pat. Nos. 4,879,857 and 4,890,434. Referred to as floating systems, these sub-floors are not anchored to the concrete substrate but rather rest on individual resilient pad supports.

One way to improve stability of a sports flooring system is to anchor or fasten the sub-floor to the underlying concrete substrate. Anchored systems are especially resistant to buckling or upward movement associated with sports floors under changing environmental conditions. Furthermore, attempts have been made to combine the resiliency of floating systems and the stability of anchored systems. For example, U.S. Pat. No. 4,856,250 incorporates a suspended sleeper resting on resilient pads. The sleeper and pads are encased by flanges of a steel channel which are secured to a substrate by means of steel concrete anchors. U.S. Pat. No. 5,016,413 incorporates isolated sub-floor panels, typically two (2) plywood layers suspended on a resilient layer. U or T shaped steel channels are secured between the spaced sub-floor panels in a manner to allow outward flanges of the channel to rest upon a lower ridge in the plywood sub-floor. The channel is fastened to the substrate by means of concrete anchors.

SUMMARY

Described hereinafter is a sub-floor system that includes sub-floor panels that are adapted to be integrally overlapped while providing clearance for the channel sections when the floor deflects under load. Clearance for the channel sections may be achieved by providing pockets in an upper layer of a first sub-floor panel in the area where the channel sections engage a second sub-floor panel with which the first sub-floor panel is in overlapping engagement.

An understanding of the advantages, objects, features, properties and relationships of the sub-floor assembly will be obtained from the following detailed description and accompanying drawings which set forth illustrative embodiments which are indicative of the various ways in which the principles of the sub-floor assembly may be employed.

BRIEF DESCRIPTION OF THE DRAWINGS

A sub-floor assembly and a method for installing the same is described with reference to the following drawings in which.

DETAILED DESCRIPTION

Figure 1:
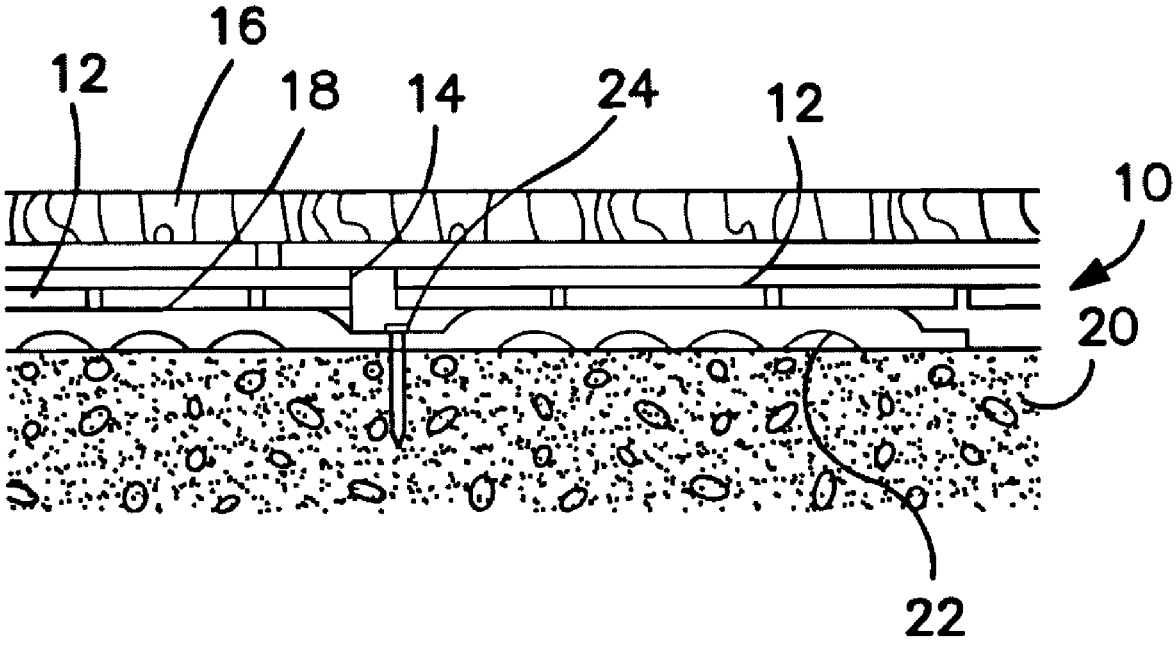
FIG. 1 illustrates a cross-sectional view of a sports floor including an exemplary sub-floor assembly.

Turning now to the figures, wherein like reference numerals refer to like elements, an exemplary sub-floor assembly and method for installing such a sub-floor assembly is described. In general, the described sub-floor assembly is particularly suited for placement under a sports floor. The sub-floor assembly preferably rests on a substrate which is typically concrete. Advantageously, the described sub-floor assembly is relatively simpler to install, is generally more uniform, and allows for a level and evenly loaded sports floor which is resilient and which has a high degree of stability.

To provide these and other advantages, the sub-floor assembly 10 comprises a plurality of sub-floor panels 12 which are adapted to be integrally overlapped while providing clearance for channel sections 14 when a sports flooring 16 deflects under load. As illustrated in FIG. 1, the sub-floor panels 12 rest on a resilient cushion 18 which, in turn, is disposed upon a base surface 20, such as a concrete underflooring. The resilient cushion 18 is preferably constructed from a generally compressible, moldable material, such as a urethane material or an elastomer material. The resilient cushion 18 may be employed under the sub-floor panels 18 using a number of smaller, spaced pads and/or continuous strips that generally co-extend underneath the surfaces of the sub-floor panels 12. The resilient cushion 18 may also be a full blanket of generally compressible, moldable material. Still further, the resilient cushion 18 may have at least one surface that is provided with convolutions and/or dimples 22 which are preferably arranged so as to face the base surface 20. While not illustrated, a vapor barrier may be disposed intermediate the base surface 20 and the resilient cushion 18.

Figure 4:
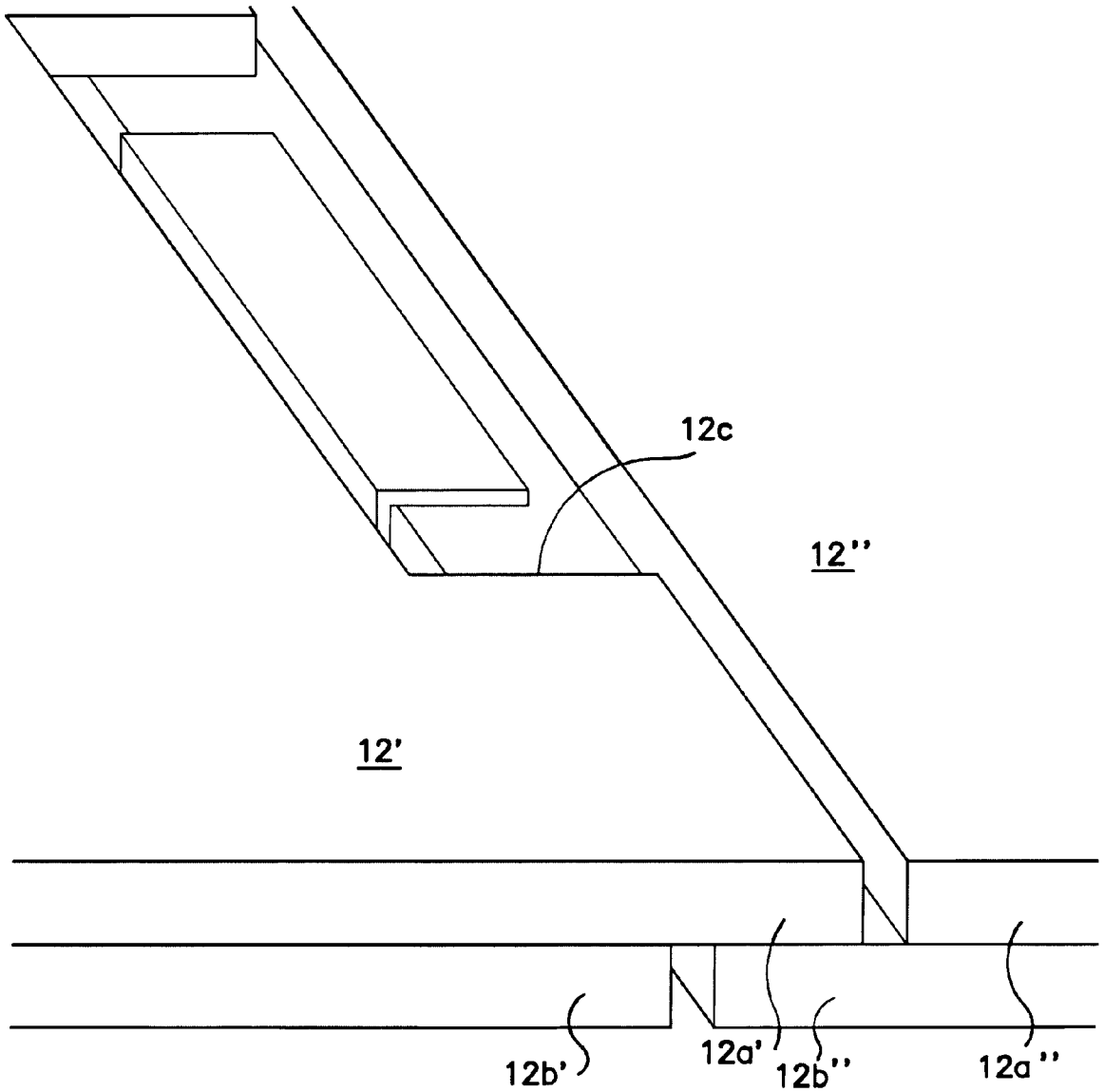
FIG. 4 illustrates a perspective view of adjacent, exemplary sub-floor panels and an exemplary channel section comprising a part of the sub-floor assembly illustrated in FIG. 1.

For allowing adjacent sub-floor panels 12 to be placed into integrally overlapped relationship with respect to each other, a first of the sub-floor panels 12 includes a side that is arranged in a manner that is generally complimentary to an opposite side of a second of the sub-floor panels 12. More particularly, as illustrated in FIG. 4, a sub-floor panel 12 generally comprises an upper portion 12*a* and lower portion 12*b*. A complimentary arrangement of the sides may then be achieved by providing one side of a sub-floor panel 12' with an upper portion 12*a'* that extends beyond its lower portion 12*b'* while providing the opposite side of the other sub-floor panel 12" with a lower portion 12*b"* that extends beyond the upper portion 12*a*". In this manner, when these sides of the sub-floor panels 12 are placed adjacent to one another, the extending, upper portion 12*a*' of sub-floor panel 12' will integrally overlap with the extending, lower portion 12*b*" of sub-floor panel 12". It is to be appreciated that a single sub-floor panel 12 may be provided with both side arrangements, e.g., the extending upper portion 12*a* on one side and the extending lower portion 12*b* on the opposite side, as is clearly illustrated in FIG. 2. It will also be appreciated that this arrangement of the sides of the sub-floor panel 12 may be achieved by shaping a single piece of sub-floor paneling or by constructing the sub-floor panel 12 from two pieces of sub-floor paneling that are generally offset with respect to one another. Preferably, the sub-floor paneling is of plywood construction or other wood that is sufficiently rigid to support the floor.

Figure 3:
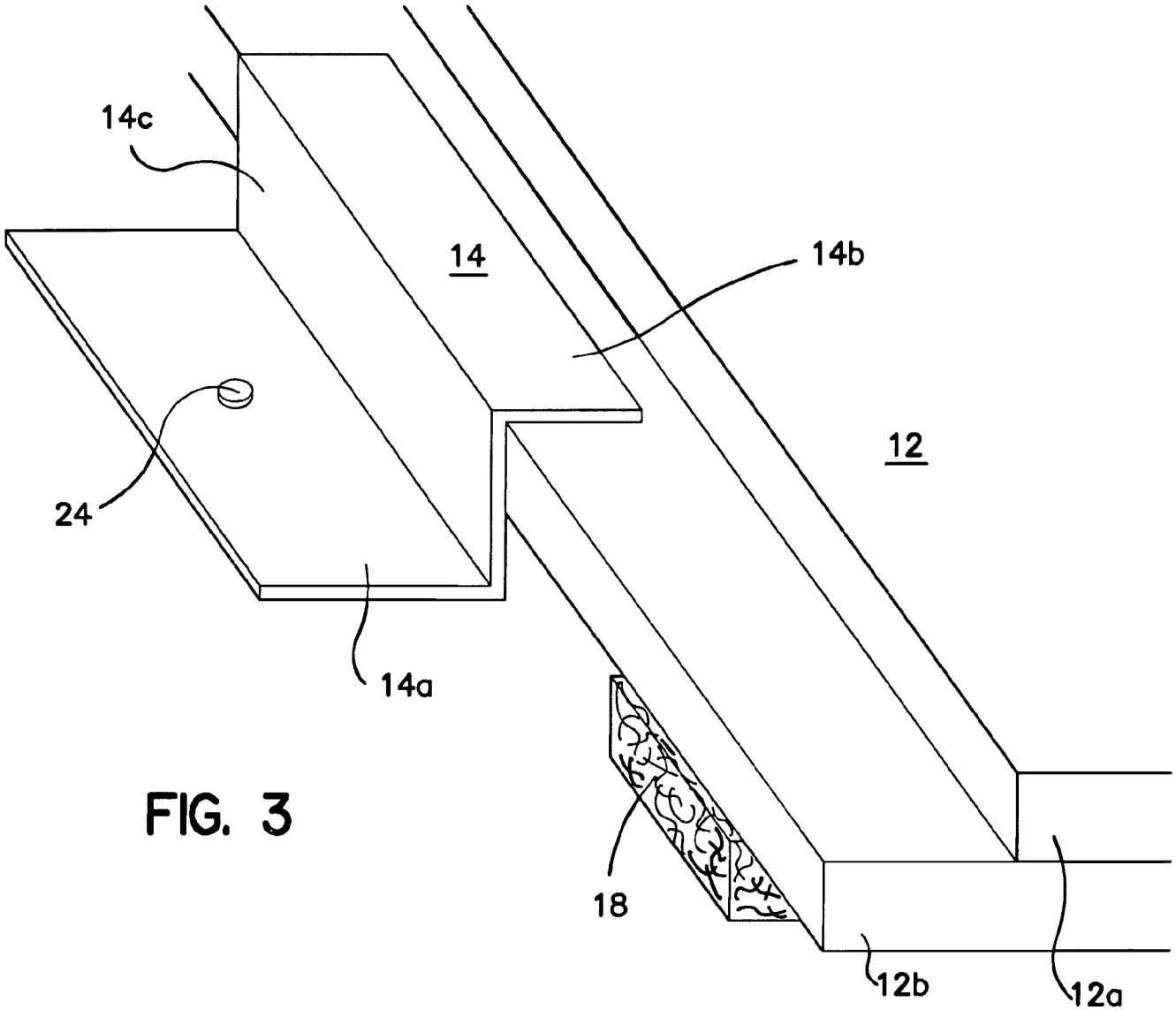
FIG. 3 illustrates a perspective view of an exemplary channel section utilized in connection with the sub-floor panel of FIG. 2.

To anchor the sub-floor panels 12 to the base surface 20, the sub-floor assembly utilizes channel sections 14 that are adapted to be secured to the base surface 20 and to engage the extending lower portion 12*b* of a sub-floor panel 12, as illustrated in FIG. 3. More particularly, the channel section 14 may be provided with a lower tab 14*a* which is to be fastened to the base surface 20, for example by means of an anchor 24, and an upper tab 14*b* that is adapted to overlappingly engage the lower portion 12*b* of the sub-floor panel 12. The non-fastened, overlapping engagement between the upper tab 14*b* of the channel section 14 and the lower extending portion 12*b* of the sub-floor panel 12 functions to inhibit the upward movement of the sub-floor panel 12 (such movement being limited by the channel section 14) while allowing the sub-floor panel 12 to be moved downward against the resilient padding 18 when subjected to a deflecting load. In the illustrated example, the channel section 14 generally has a "S" shape wherein the lower tab 14*a* extends generally horizontally from a generally vertically oriented middle portion 14*c* from which the upper tab 14*b* extends generally horizontally in a direction opposite the lower tab 14*a*. Preferably, the channel section 14 is constructed from a generally non-resilient material such as steel.

Figure 5:
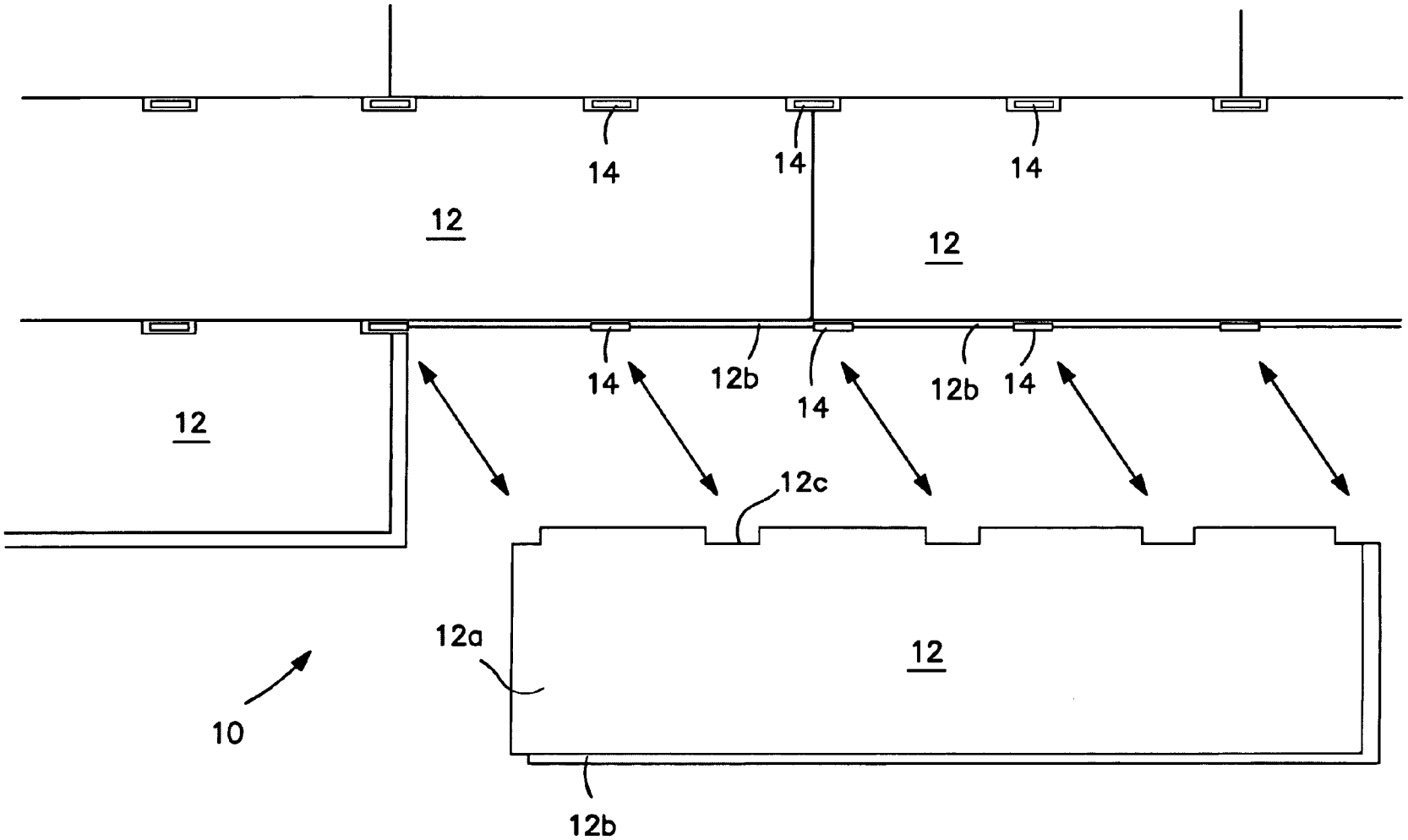
FIG. 5 illustrates an overhead view of an assemblage of exemplary sub-floor panels and exemplary channel sections comprising a part of the sub-floor assembly illustrated in FIG. 1.

As further illustrated in FIGS. 4 and 5, uniformity of the sports floor is particularly achieved by allowing an overlapping sub-floor panel 12 to also move downwardly when the sports floor deflects under load. To this end, the overlapping sub-floor panel 12 is provided with the ability to clear the channel section 14 that is being used to anchor the side of the sub-floor panel 12 with which the overlapping sub-floor panel 12 is integrally engaged with. In this regard, clearance for the channel section 14 may be achieved by providing pockets 12*c* in the upper portion 12*a* of the overlapping sub-floor panel 12 (e.g., sub-floor panel 12' of FIG. 4) in the area where the channel section 14 engages the lower portion 12*b* of the sub-floor panel 12 that is in integral engagement with the overlapping sub-floor panel 12 (e.g., sub-floor panel 12" of FIG. 4). Since the pocket 12*c* is sized and arranged such that contact between the upper portion 12*a* of the sub-floor panel 12 and the channel section 14 is avoided, the sub-floor panels 12 on either side of the channel section 14 are free to move downwardly under a deflecting load.

In the example sub-floor assembly illustrated in FIG. 5, five, spaced channel sections 14 are utilized to anchor one side of each sub-floor panel 12 and, as such, five pockets 12*c* are formed in the adjacent, overlappingly engaging sub-floor panel(s) 12 to provide clearance for the five channel sections 14. In this regard, three channel sections 14 are utilized to anchor one sub-floor panel 12 exclusively while two channel sections 14, one located on either end of a sub-floor panel 12, are utilized to anchor two sub-floor panels positioned adjacent within a row. Similarly, three pockets 12*c* are formed within one sub-floor panel 12 exclusively while two pockets 12*c* are formed through the adjoinment of two-half pockets formed in opposite ends of sub-floor panels 12 positioned adjacent in a row.

Figure 2:
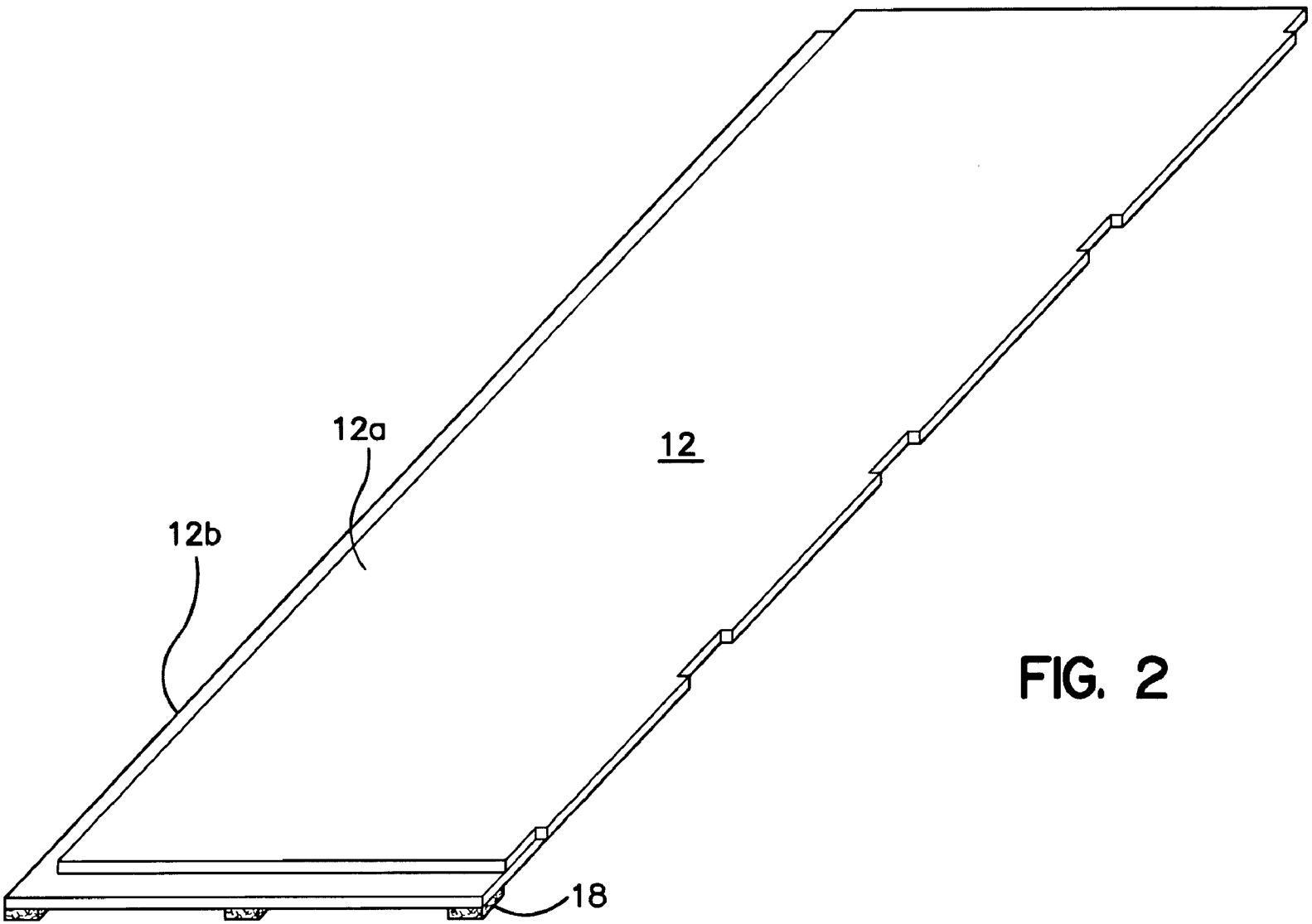
FIG. 2 illustrates a perspective view of an exemplary sub-floor panel for use in connection with the sub-floor assembly illustrated in FIG. 1.

When installed, sub-floor panels 12 that comprise a row may be staggered with respect to the sub-floor panels 12 that comprise an adjacent row such that adjoined ends of sub-floors 12 within a row are offset from the adjoined ends of sub-floors 12 in the adjacent rows. Once installed, attached to these arranged sub-floor panels 12 would be the sports flooring 16, for example maple floor boards that extend transversely to the sub-floor panels 12. As further illustrated in FIG. 5, the integral overlapping engagement between sub-floor panels 12 may also include the ends of the sub-floor panels (as well as the sides as described previously). For example, the sub-floor panels 12 may be constructed to have an approximate three inch overhang on the end with a corresponding three inch ledge on the opposite end and an approximate one inch overhang on the side with a corresponding one inch ledge on the opposite side, as illustrated in FIG. 2.

While the foregoing has described an example sub-floor assembly that is relatively simpler to install and is generally more uniform, it will be appreciated by those skilled in the art that various modifications and alternatives to the concepts disclosed could be developed in light of the overall teachings of this disclosure. As such, the particular concepts disclosed are meant to be illustrative only and not limiting as to the scope of the invention which is to be given the full breadth of the appended claims and any equivalents thereof.

The invention claimed is:

1. A flooring system, comprising:

first and second sub-floor panels having complimentary, opposed sides disposed in integral overlapping relation;

resilient material disposed under the first and second sub-floor panels; and a channel section engaging the complimentary, opposed side of the second sub-floor panel, the channel section positioned intermediate the first sub-floor panel and the second sub-floor panel and limiting movement of the complimentary, opposed side of the second sub-floor panel in a vertical upward direction while permitting movement of the second sub-floor panel in a vertical downward direction against the resilient force of the resilient material;

wherein a the complimentary, opposed side of the first sub-floor panel has a pocket in which the channel section is positioned, the pocket being sized and arranged such that the first sub-floor panel avoids overlapping contact with at least a portion of the channel section that engages with the complimentary, opposed side of the second sub-floor panel to thereby permit movement of the first sub-floor panel in a vertical downward direction against the resilient force of the resilient material, when the second sub-floor panel moves in a vertical downward direction.

2. The flooring system as recited in claim 1, further comprising sports flooring attached to the first and second sub-floor panels.

3. The flooring system as recited in claim 1, wherein the first sub-floor panel has an upper portion and a lower portion, the upper portion extending beyond the lower portion to form an overhang on the complimentary, opposed side of the first sub-floor panel; the second sub-floor panel has an upper portion and a lower portion, the lower portion extending beyond the upper portion to form a ledge on the complimentary, opposed side of the second sub-floor panel; and the overhang of the first sub-floor panel side engages the ledge of the second sub-floor panel side.

4. The flooring system as recited in claim 3, wherein the channel section engages the ledge of the second sub-floor panel.

5. The flooring system as recited in claim 4, wherein the channel section is generally "S" shaped.

6. The flooring system as recited in claim 4, wherein the pocket is formed in the overhang of the first sub-floor panel.

7. The flooring system as recited in claim 3, wherein the first sub-floor panel and the second sub-floor panel each comprise a pair of plywood panels arranged in offset relation.

8. The flooring system as recited in claim 3, wherein the upper portion of the first sub-floor panel extends beyond the lower portion to form an overhang on an end of the first sub-floor panel to allow the first sub-floor panel to integrally overlappingly engage a ledge of an end of a third, adjacent sub-floor panel.

9. The flooring system as recited in claim 3, wherein the lower portion of the first sub-floor panel extends beyond the upper portion to form a ledge on an end of the first sub-floor panel to allow the first sub-floor panel to integrally overlappingly engage an overhang of an end of a third, adjacent sub-floor panel.

10. The flooring system as recited in claim 1, wherein the resilient material comprises convolutions on a side opposite the first and second sub-floor panels.

11. A method of installing a flooring system, comprising:

placing complimentary, opposed sides of first and second sub-floor panels in integral overlapping relation, the first and second sub-floor panels being disposed over a resilient material; and placing a channel section intermediate the first sub-floor panel and the second sub-floor panel, the channel section being positioned to engage the complimentary, opposed side of the second sub-floor panel so as to limit movement of the complimentary, opposed side of the second sub-floor panel in a vertical upward direction while permitting movement of the second sub-floor panel in a vertical downward direction against the resilient force of the resilient material and being positioned within a pocket formed in the complimentary, opposed side of the first sub-floor panel, the pocket being sized and arranged such that the first sub-floor panel avoids overlapping contact with at least a portion of the channel section that engages with the complimentary, opposed side of the second sub-floor panel to thereby permit movement of the first sub-floor panel in a vertical downward direction against the resilient force of the resilient material, when the second sub-floor panel moves in a vertical downward direction.

12. The method as recited in claim 11, comprising attaching sports flooring to the first and second sub-floor panels.

13. The method as recited in claim 11, wherein the complimentary, opposed side of the first sub-floor panel has an upper portion and a lower portion, the upper portion extending beyond the lower portion to form an overhang; the complimentary, opposed side of the second sub-floor panel has an upper portion and a lower portion, the lower portion extending beyond the upper portion to form a ledge; and the overhang of the first sub-floor panel is positioned so as to engage the ledge of the second sub-floor panel.

14. The method as recited in claim 13, wherein the channel section is positioned so as to engage the ledge of the second sub-floor panel.

15. The method system as recited in claim 13, wherein the pocket is formed in the overhang of the first sub-floor panel.

* * * * *